US011709038B2

(12) United States Patent
Rogers

(10) Patent No.: US 11,709,038 B2
(45) Date of Patent: Jul. 25, 2023

(54) STABILIZING SUPPORT DEVICE FOR CAKE FIREWORKS

(71) Applicant: Thomas Rogers, Margate, FL (US)

(72) Inventor: Thomas Rogers, Margate, FL (US)

( * ) Notice: Subject to any disclaimer, the term of this patent is extended or adjusted under 35 U.S.C. 154(b) by 0 days.

(21) Appl. No.: 17/519,892

(22) Filed: Nov. 5, 2021

(65) Prior Publication Data

US 2023/0026838 A1 Jan. 26, 2023

Related U.S. Application Data

(60) Provisional application No. 63/203,490, filed on Jul. 25, 2021.

(51) Int. Cl.
*F42B 4/20* (2006.01)
*F42B 4/14* (2006.01)

(52) U.S. Cl.
CPC . *F42B 4/20* (2013.01); *F42B 4/14* (2013.01)

(58) Field of Classification Search
CPC ..... F42B 4/20; F42B 4/00
See application file for complete search history.

(56) References Cited

U.S. PATENT DOCUMENTS

| | | | | |
|---|---|---|---|---|
| 2003/0070572 | A1* | 4/2003 | Tang | F41A 19/65 102/349 |
| 2005/0133472 | A1* | 6/2005 | Deye | F42B 4/20 211/60.1 |
| 2009/0145321 | A1* | 6/2009 | Russell | F42D 1/05 102/200 |
| 2011/0017088 | A1* | 1/2011 | Steadman, Sr. | F42B 4/20 102/358 |
| 2017/0067722 | A1* | 3/2017 | Garcia Gamon | F42B 4/20 |

FOREIGN PATENT DOCUMENTS

| | | | | |
|---|---|---|---|---|
| DE | 10232222 A1 * | 3/2003 | | F42B 4/20 |
| EP | 2221574 A1 * | 8/2010 | | F42B 4/06 |
| FR | 3088111 A1 * | 5/2020 | | F42B 4/20 |
| GB | 2479356 A * | 10/2011 | | F42B 4/20 |
| NL | 1011508 C1 * | 7/1999 | | |

OTHER PUBLICATIONS

Machine Translation of Zickner. <https://translationportal.epo.org/emtp/translate/?ACTION=description-retrieval&COUNTRY=DE&ENGINE=google&FORMAT=docdb&KIND=A1&LOCALE=en_EP&NUMBER=10232222&SRCLANG=de&TRGLANG=en>. Mar. 2003. (Year: 2003).*

* cited by examiner

*Primary Examiner* — Gabriel J. Klein

(57) ABSTRACT

The stabilizing support device for cake fireworks is a device used to provide users with a supporting platform for fireworks, that prevents firework cakes from flipping over and causing unnecessary injuries. To accomplish this, the device includes a stable platform and a plurality of fastening means. Preferably, the device may hold a plurality of cake fireworks and may launch fireworks separately or all together. The device can further ignite the firework electronically through wireless communication. This can improve firework shows for everyday consumers can bring a backyard firework show to a professional firework display level. Furthermore, the device includes support stands that have the capabilities to shoot the fireworks in multiple angles and multiple heights. This can help families who have very little knowledge on how to put together a proper firework show. Additionally, the device can also be folded and fit into a small size carryon bag.

14 Claims, 14 Drawing Sheets

STABILIZING SUPPORT DEVICE FOR CAKE FIREWORKS

The current application claims a priority to the U.S. Provisional Patent application Ser. No. 63/203,490 filed on Jul. 25, 2021.

FIELD OF THE INVENTION

The present disclosure relates generally to a support device. More specifically, the present disclosure describes a stabilizing and supporting platform for holding cake fireworks in a secure fashion.

BACKGROUND OF THE INVENTION

A cake firework, also known as a multiple tube device, is a firework comprising a series of Roman candle, small aerial shells, or a combination of both, connected together by a high-speed fuse. Typically, the internal fusing is set to fire each tube in series, or to fire several tubes at the same time, or a combination of these. Cakes vary greatly in size, weight and duration. Some last only a few seconds and contain only a few tubes, while others may last for several minutes, contain upwards of 1,000 tubes, and measure over a cubic yard in size. If not secure, fireworks can easily flip over, and cause serious injuries to the eyes, hands and/or feet. It can also cause serious burns on the body. Further, the currently available platforms for fireworks don't allow users to fire the cakes in multiple directions and angles.

An objective of the present invention is to provide users with a supporting platform for fireworks, that prevents fireworks from flipping over and causing unnecessary injuries. To accomplish this, the present invention comprises a stable platform and fastening means to secure the firework over the platform. According to a preferred embodiment, the present invention may hold a plurality of cake fireworks and may launch fireworks separately or all together. Further, the present invention may ignite the firework via wireless electronic means. This can improve firework shows for everyday consumers. Additionally, this can bring a backyard firework show to a professional firework display level. The present invention comprises support stands that have the capabilities to shoot the fireworks in multiple angles from different heights. This can help families who have very little knowledge on how to put together a proper firework show. Furthermore, the present invention may also be folded and fit into a small size carryon bag.

DETAIL DESCRIPTIONS OF THE INVENTION

All illustrations of the drawings are for the purpose of describing selected versions of the present invention and are not intended to limit the scope of the present invention.

In reference to FIG. 1 through FIG. 14, the present invention is a firework cake supporting device. An objective of the present invention is to provide users with a supporting platform for fireworks, that prevents fireworks from flipping over and causing unnecessary injuries. To accomplish this, the present invention comprises a stable platform and fastening means to secure the firework over the platform. According to a preferred embodiment, the present invention may hold a plurality of cake fireworks and may launch fireworks separately or all together. Further, the present invention may ignite the firework via wireless electronic communication and send electric sparks to ignite the fireworks. This can improve firework shows for everyday consumers. Additionally, this can bring a backyard firework show to a professional firework display level. The present invention further comprises support stands that have the capabilities to shoot the fireworks in multiple angles from different heights. This can help families who have very little knowledge on how to put together a proper firework show. Furthermore, the present invention may also be folded and fit into a small size carryon bag.

Figure 13:
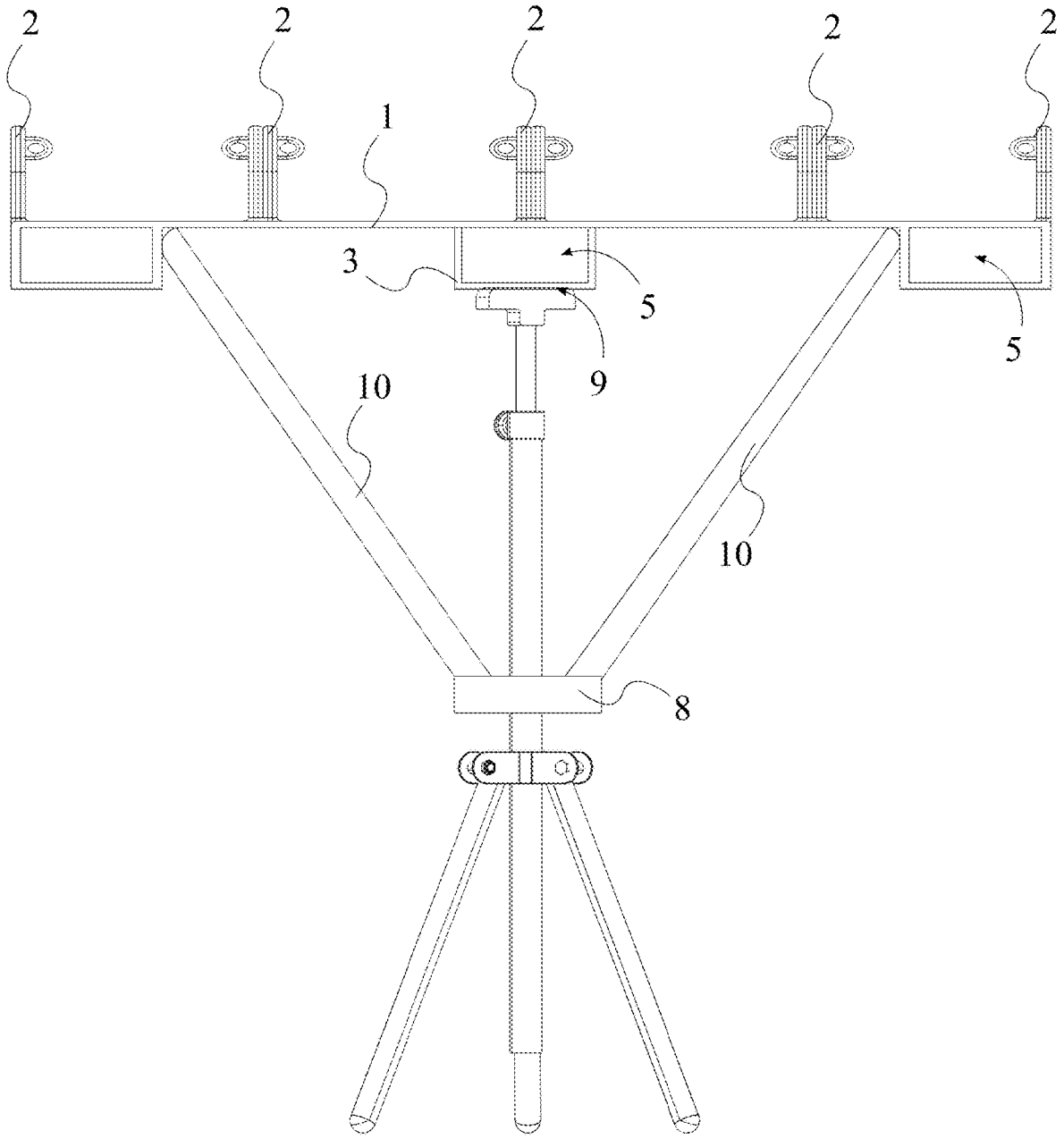
FIG. 13 is a front elevational view of the present invention, wherein a platform with multiple sidewalls is positioned over the tripod stand.
Figure 14:
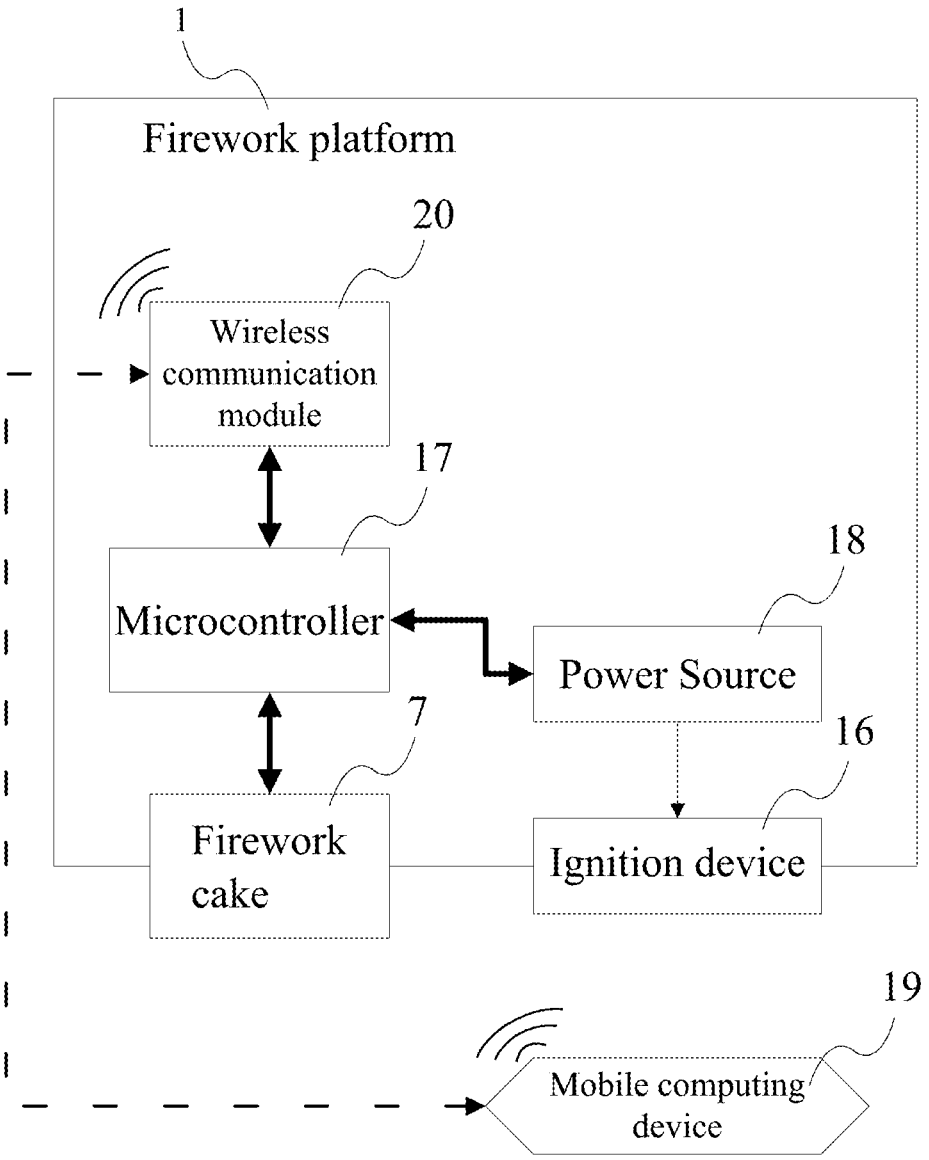
FIG. 14 is a block diagram of the present invention, wherein thinner flowlines represent electrical connection, thicker flowlines represent electronic connection, and dashed flowlines represent wireless communication.

The following description is in reference to FIG. 1 through FIG. 14. According to a preferred embodiment, the present invention comprises a firework platform 1, a plurality of sidewalls 2, a plurality of weighted legs 3, at least one fastener 4, and a plurality of weight slots 5. Preferably, the firework platform 1 is a planar hard surface, such as a wooden plank, that may hold at least one firework cake. As seen in FIG. 1 through FIG. 4, the firework platform 1 is rectangular. However, the firework platform 1 may comprise any other size, shape, material, components, and arrangement of components that are known to one of ordinary skill in the art, as long as the intents of the present invention are not altered. Further, the firework platform 1 comprises a first surface 1*a*, and a second surface 1*b*, wherein the second surface 1*b* is positioned opposite to the first surface across the firework platform. More specifically, the first surface 1*a* constitutes an upper surface of the firework platform and the second surface 1*b* constitutes a lower surface of the firework platform 1. It is an aim of the present invention to securely hold fireworks over the firework platform without tipping. To accomplish this and to provide the necessary support from two sides of the firework, the present invention comprises the plurality of sidewalls 2. As seen in FIG. 1 through FIG. 4, a first sidewall 2*a* and a second sidewall 2*b* are terminally and laterally mounted onto the firework platform 1, wherein the first sidewall 2*a* and the second sidewall 2*b* are from the plurality of sidewalls 2. In other words, the first sidewall 2*a* and the second sidewall 2*b* form the terminal barriers of the firework platform 1 that prevent the sideways motion of the fireworks over the firework platform 1. Further, the plurality of sidewalls 2 act as mounting surfaces for fasteners that can securely fasten the fireworks to the firework platform 1. As seen in FIG. 6, FIG. 7, FIG. 9 and FIG. 11, the first sidewall 2*a* and the second sidewall 2*b* are foldable, thereby enabling the user to fold and carry the present invention in a carry bag. In reference to FIG. 1 through FIG. 4, the plurality of sidewalls 2 are rectangles with an arched top end. However, the plurality of sidewalls 2 may comprise any other shape, size, components and arrangement of components, as long as the objectives of the present invention are fulfilled. As seen in FIG. 1 through FIG. 4, the plurality of sidewalls 2 extends normally from the first surface 1*a*, opposite to the second surface 1*b*. Additionally, as seen in FIG. 13, the plurality of sidewalls 2 is evenly distributed along a length of the firework platform 1.

It is an objective of the present invention to provide a stable surface for the fireworks that does not tip or tilt while placing the firework cakes, as well as during launching of the fireworks. In order to accomplish this, the present invention comprises the plurality of weighted legs 3, that are mounted onto the second surface 1*b*. In the preferred embodiment, the weighted legs 3 are rectangular in shape, and they form the legs on which the firework platform 1 rests. Further, the plurality of weighted legs 3 has enough weight to balance the firework platform 1 along the center of gravity. To that end, the plurality of weighted legs 3 is evenly distributed along the length of the firework platform 1.

If the firework platform 1 needs to be placed over an uneven ground surface or irregular terrain, or an incline, the present invention provides an option to add additional weights to the weighted legs 3, so as to balance the weight of the fireworks and prevent the present invention from tipping and/or toppling. To that end, each of the plurality of weight slots 5 traverses through a corresponding leg 3*a*, wherein the corresponding leg 3*a* is from the plurality of weighted legs 3. As seen in FIG. 1 through FIG. 4, the plurality of weighted slots 5 are rectangular in shape. However, the plurality of weighted slots 5 may comprise any other shape, size, orientation, components and arrangement of components, as long as the intents of the present invention are not altered. Accordingly, the user may place additional weights in the weighted slot 5, to prevent the firework platform 1 from tipping. In other words, the plurality of weight slots 5 houses a plurality of detachable weights 6. Examples of the detachable weights 6 include sandbags, bean bags, metric weights, etc. However, any other weights that are known to one of ordinary skill in the art may be housed within the weight slots 5, as long as the intents of the present invention are not altered. Furthermore, the plurality of weighted slots 5 may also be used for hanging or holding the present invention over various surfaces by threading the present invention along any protruding surface through the plurality of slots 5.

Figure 1:
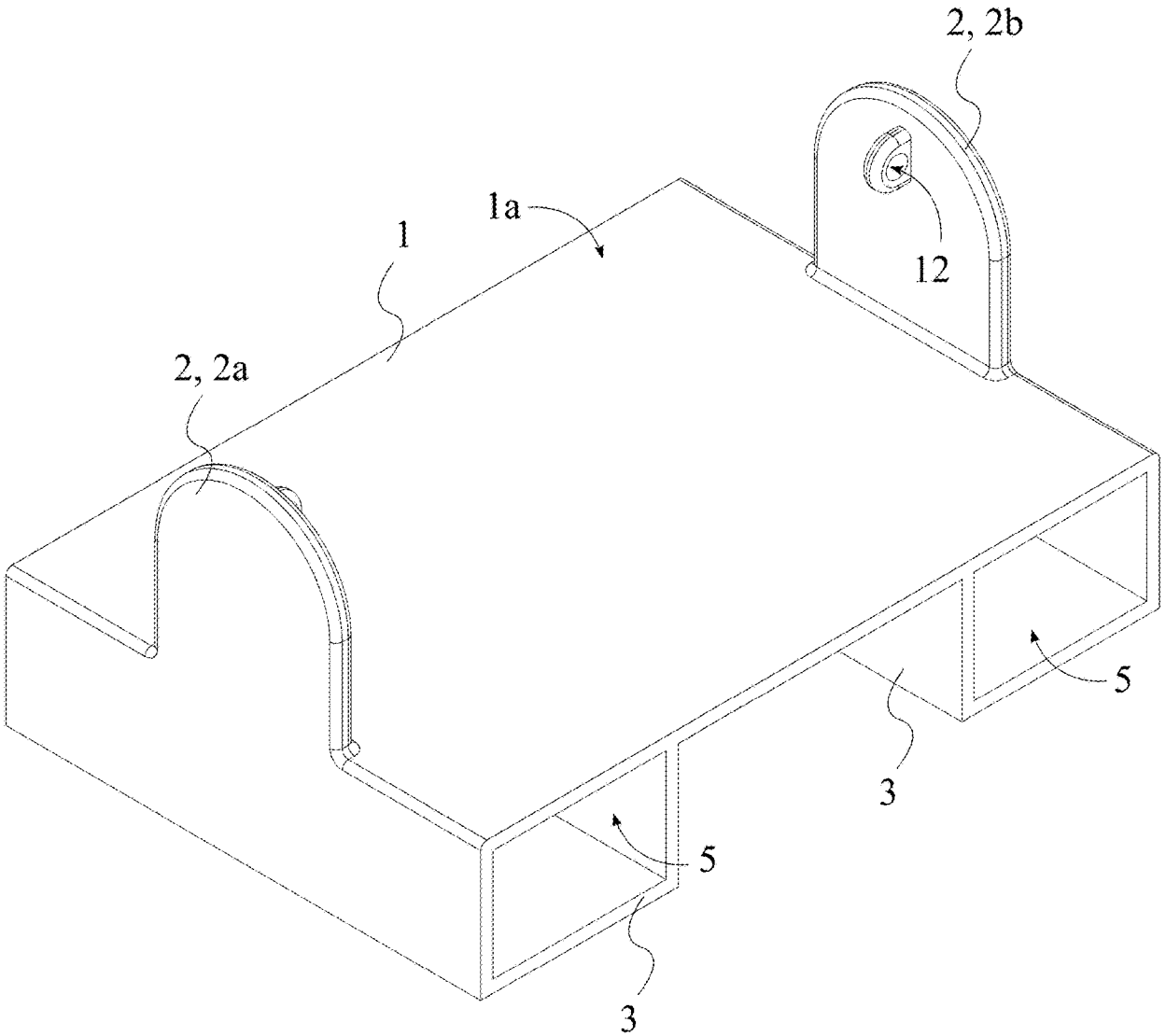
FIG. 1 is a top-front-right perspective view of the present invention.
Figure 2:
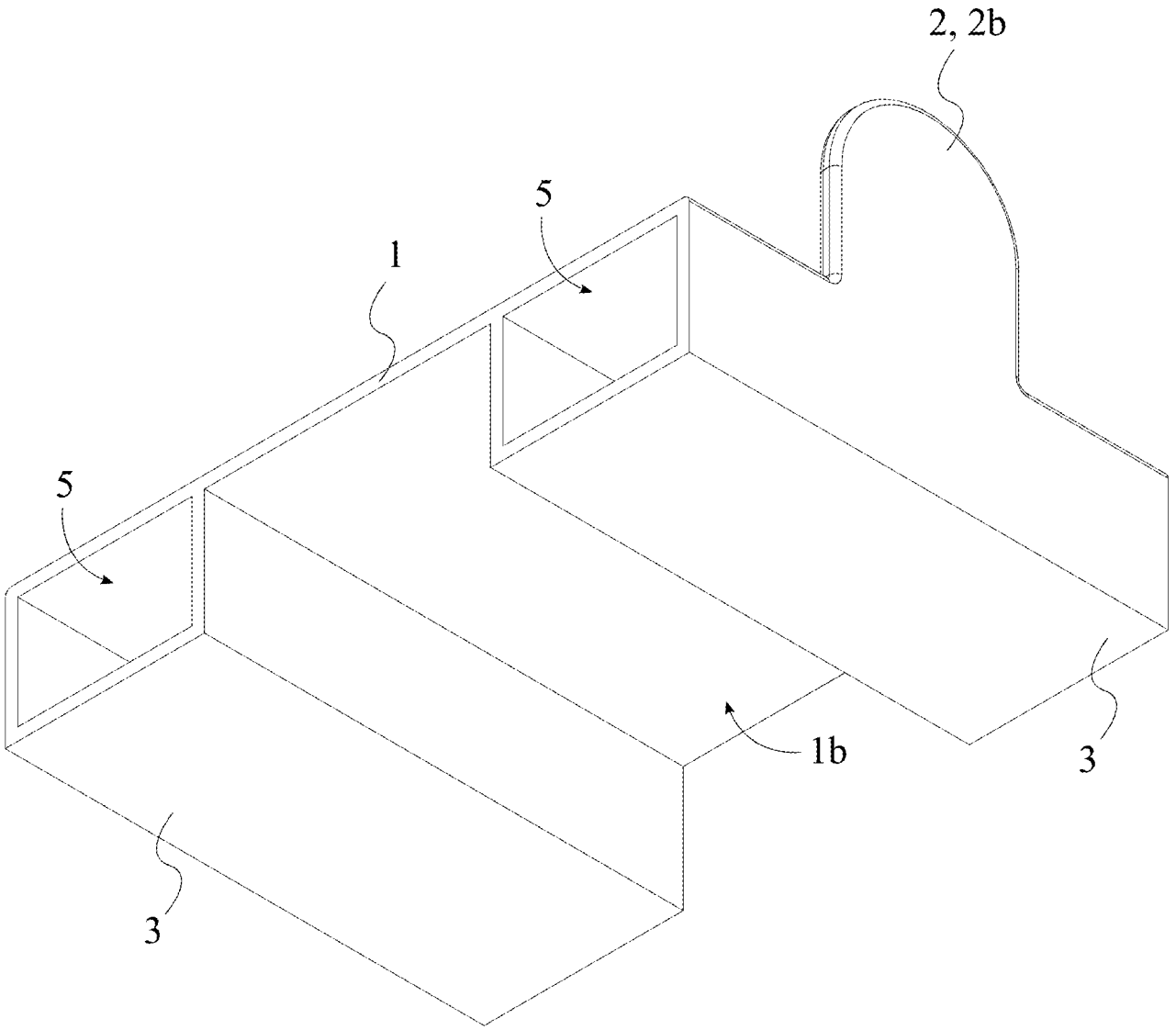
FIG. 2 is a bottom-rear-left perspective view of the present invention.
Figure 3:
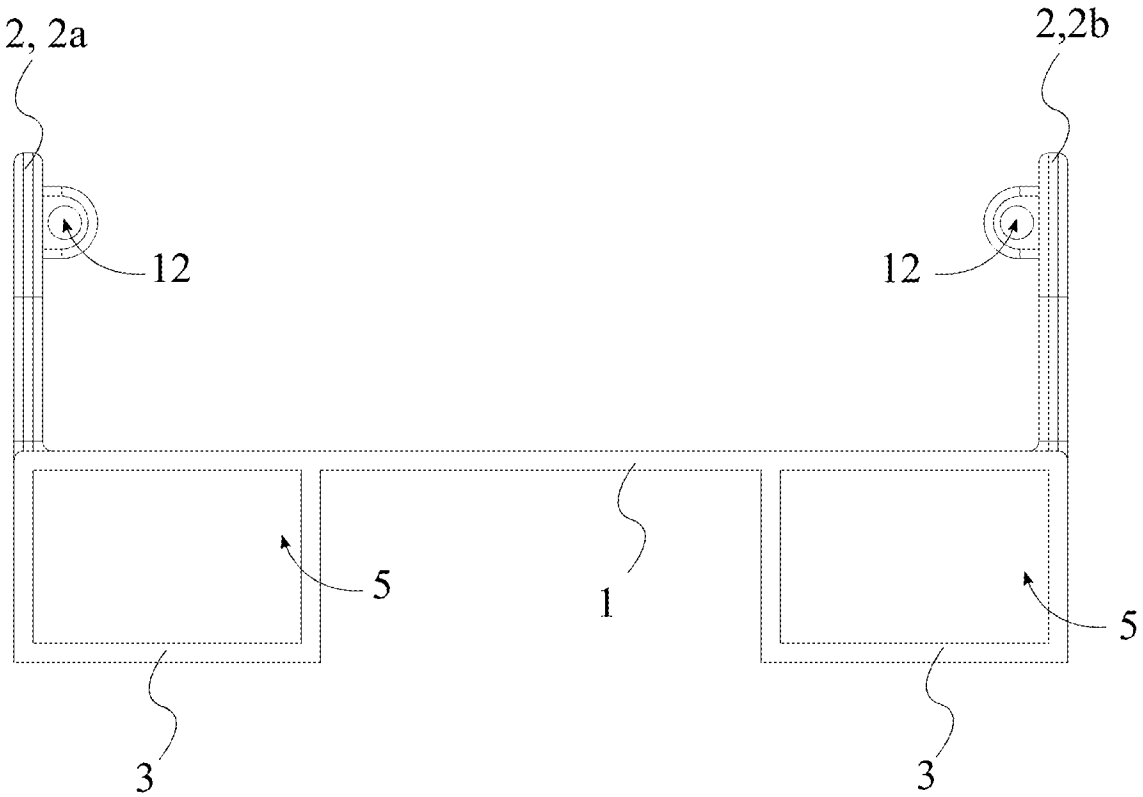
FIG. 3 is a front elevational view of the present invention.
Figure 4:
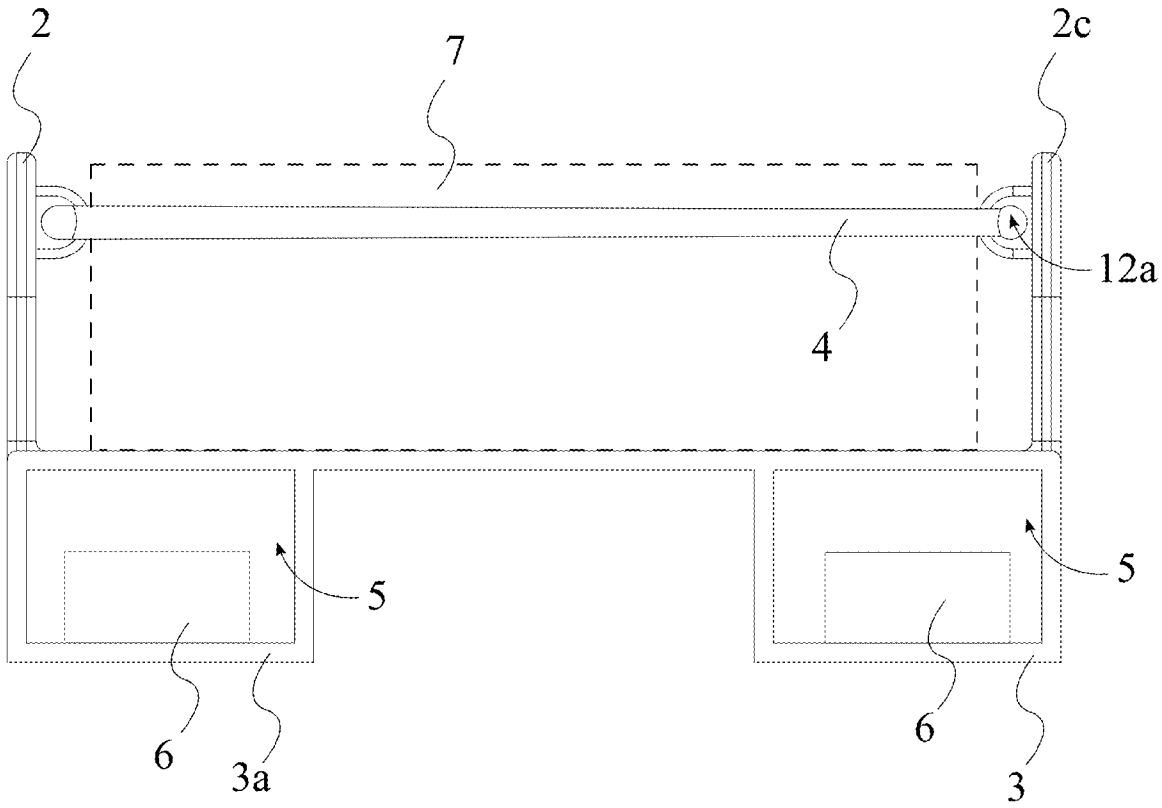
FIG. 4 is a front elevational view of the present invention, wherein a firework cake fastened by a fastener is placed in between two sidewalls.
Figure 5:
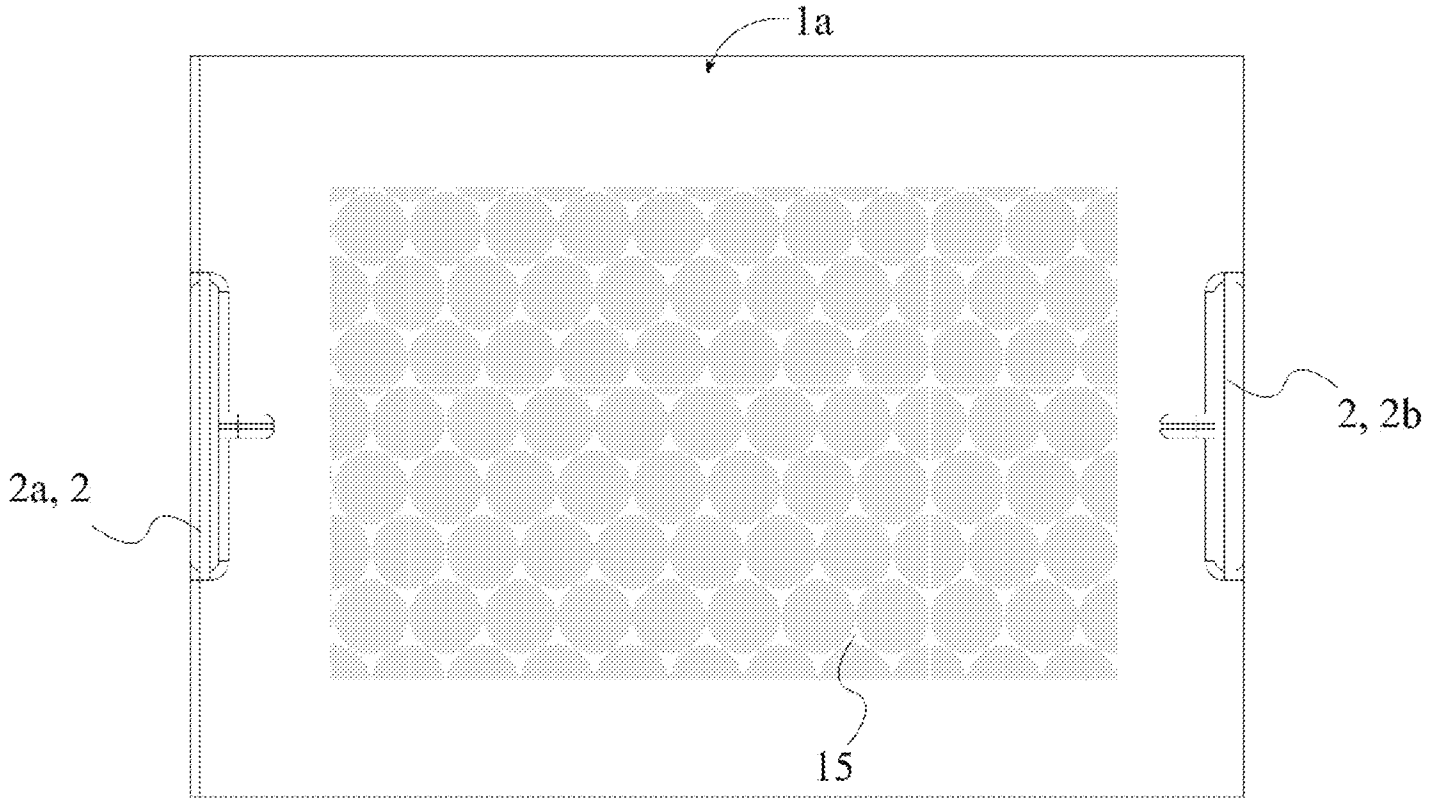
FIG. 5 is a top plan view of the present invention, wherein a gripping surface is shown.

As seen in FIG. 4, and in order to securely fasten the fireworks to the present invention, each of the at least one fastener 4 is engaged with a corresponding sidewall 2*c*, wherein the corresponding sidewall 2*c* is from the plurality of sidewalls 2. Preferably, the at least one fastener 4 is wound around the firework in a secure fashion and connected to the plurality of sidewalls 2. Examples of the at least one fastener 4 include, but are not limited to hook and loop fasteners, bungy cords, cables, zip ties etc. According to the preferred embodiment, the present invention comprises at least one firework cake 7. As seen in FIG. 4, the at least one firework cake 7 is positioned on the first surface 1*a* and in between the plurality of sidewalls 2. Further, the at least one fastener 4 is operably coupled with the at least one firework cake 7, such that the at least one fastener 4 securely fastens the at least one firework cake 7 onto the first surface 1*a* of the firework platform a. Preferably, the firework is in the form of a cake. However, the at least one fastener 4 and the firework platform 1 may be used to securely hold any form of fireworks, such as bottle rockets, roman candles & mortars, small aerial shells etc.

It is an aim of the present invention to enable users to raise the height of fireworks to prevent low breaking explosions. The height and angle adjustment option of the present invention also prevents users from bending down low to ignite fireworks, thereby preventing any further injury. In order to accomplish this, the present invention comprises a support stand 8 and a support surface 9. In the preferred embodiment, the support surface 9 is terminally mounted onto the support stand 8, in such a way that the second surface 1*b* of the firework platform 1 is detachably mounted onto the support surface 9. Further, according to the present invention, the supporting stand 8 is height adjustable, and an angle of orientation of the support surface is adjustable. As seen in FIG. 9 through FIG. 13, the support stand 8, and the support surface 9 may comprise any size, shape, and technology, as long as the objectives of the present invention are fulfilled.

In reference to FIG. 13, the firework platform 1 comprises multiple sidewalls that enable securely fastening a plurality of fireworks over the firework platform 1. Further, in this embodiment, wherein the support stand 8 is a tripod stand, the support surface 9 comprises a plurality of supporting arms 10, and the plurality of supporting arms 10 is axially mounted onto the support stand 8. In other words, by adjusting the angle between the plurality of supporting arms 10 and the support stand 8, the height of the firework platform 1 may be adjusted. The positional height of the firework platform 1 may also be adjusted by adjusting the support stand 8. The height adjustability feature enables users to extend or fold the length of the support stand 8, which further enables for easy transportation.

In an alternate embodiment, the present invention may use hydraulics. In other words, in an alternate embodiment, the present invention may comprise hydraulic cylinders to adjust the height of the support stand 8. Other height adjustability technology, such as scissor lift that use hydraulics may also be utilized for the support stand 8.

Figure 9:
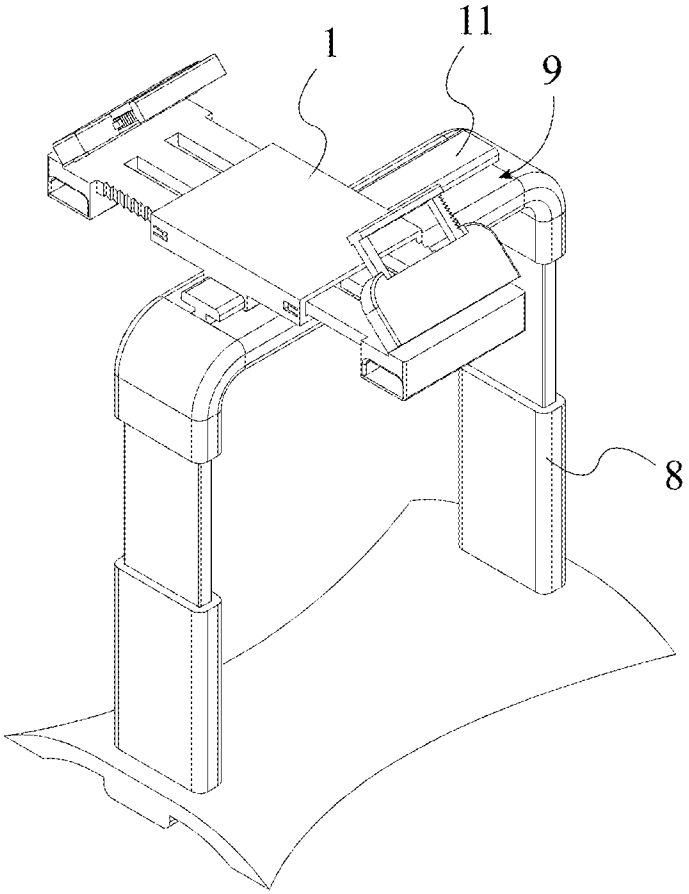
FIG. 9 is a top-front-right elevational view of the extendable platform over a bipedal stand.
Figure 10:
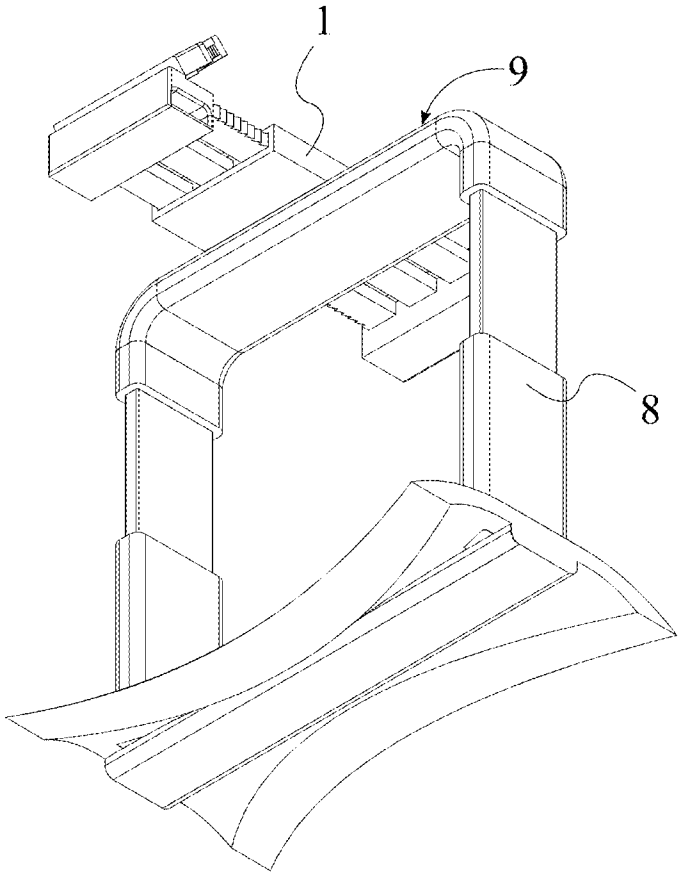
FIG. 10 is bottom-rear-left perspective of the extendable platform over the bipedal stand.
Figure 11:
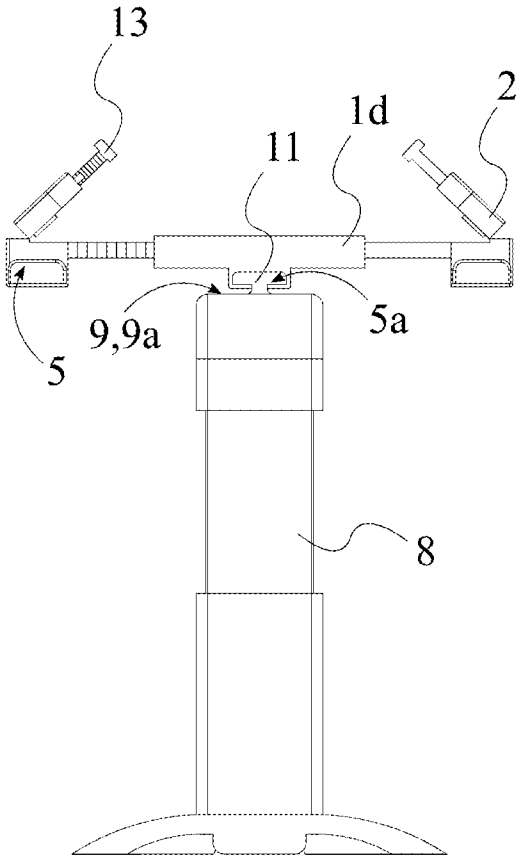
FIG. 11 is a side elevational view of the extendable platform over the bipedal stand.
Figure 12:
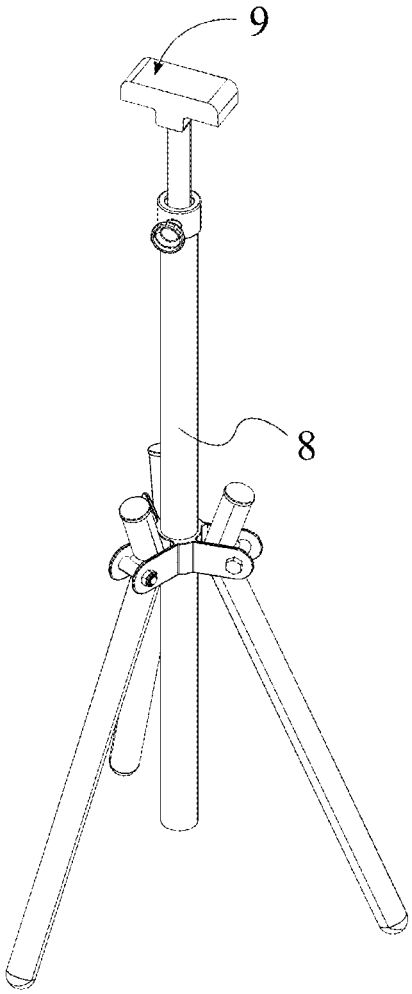
FIG. 12 is a top front left perspective view of a tripod stand according to an alternate embodiment of the present invention.

In reference to FIG. 9 through FIG. 11, wherein the support stand 8 is a bipedal stand, the support surface 9 comprises a raised handle 11. Preferably, the raised handle 11 is mounted along a third surface 9*a* of the support surface 9. More specifically, the raised handle 11 is mounted on to an upper surface of the support surface 9. This is so that the raised handle 11 may be threaded through a first slot 5*a* of a first firework platform 1*d*, wherein the first slot 5*a* is from the plurality of weight slots 5. Furthermore, in order to maintain stability, the first slot 5*a* is positioned along the center of gravity of the first firework platform 1*d*. Additionally, the support surface 9 may house a plurality of firework platforms, by sliding the first firework platform 1*d* across the raised handle 11.

As seen in FIG. 1, FIG. 3, FIG. 4, and FIG. 13, the present invention comprises a plurality of fastener holes 12. In the preferred embodiment, each of the plurality of fastener holes 12 laterally traverses through a projection on a corresponding wall, wherein the corresponding wall is from the plurality of sidewalls. Further, as seen in FIG. 4, each of the at least one fastener 4 is engaged with a corresponding fastener hole 12*a*, wherein the corresponding fastener hole 12*a* is from the plurality of fastener holes 12. However, it should be noted that the plurality of fastener holes 12 may comprise any other size, shape, orientation, location, components and arrangement of components that are known to one of ordinary skill in the art, as long as the intents of the present invention are not altered.

Figure 6:
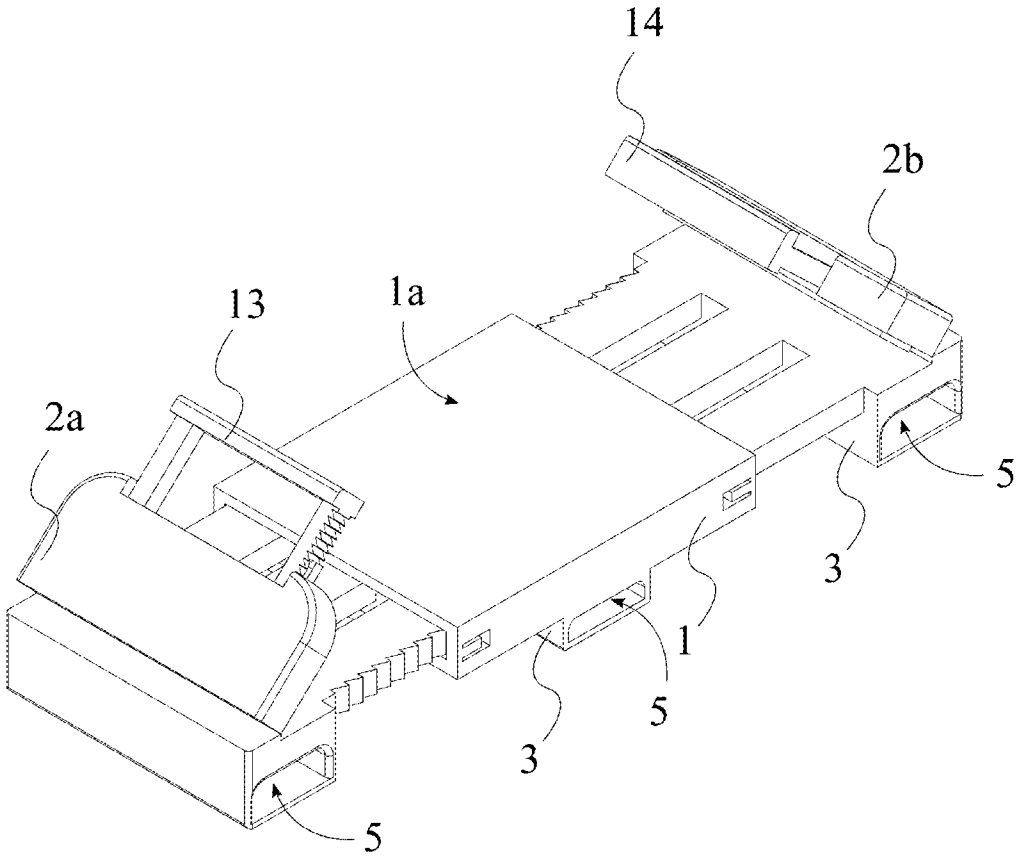
FIG. 6 is a top-front-right perspective view of an extendable platform according to a preferred embodiment of the present invention.
Figure 7:
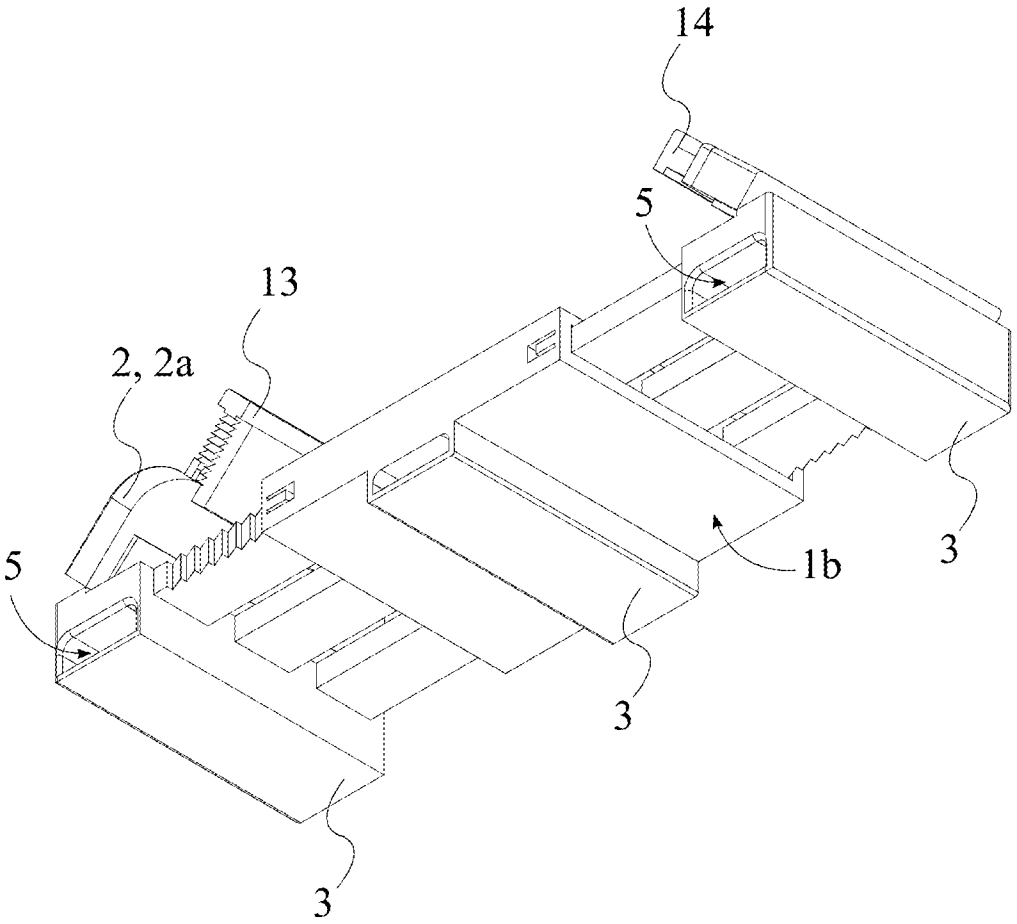
FIG. 7 is a bottom-rear-left perspective view of the extendable platform with foldable sidewalls.
Figure 8:
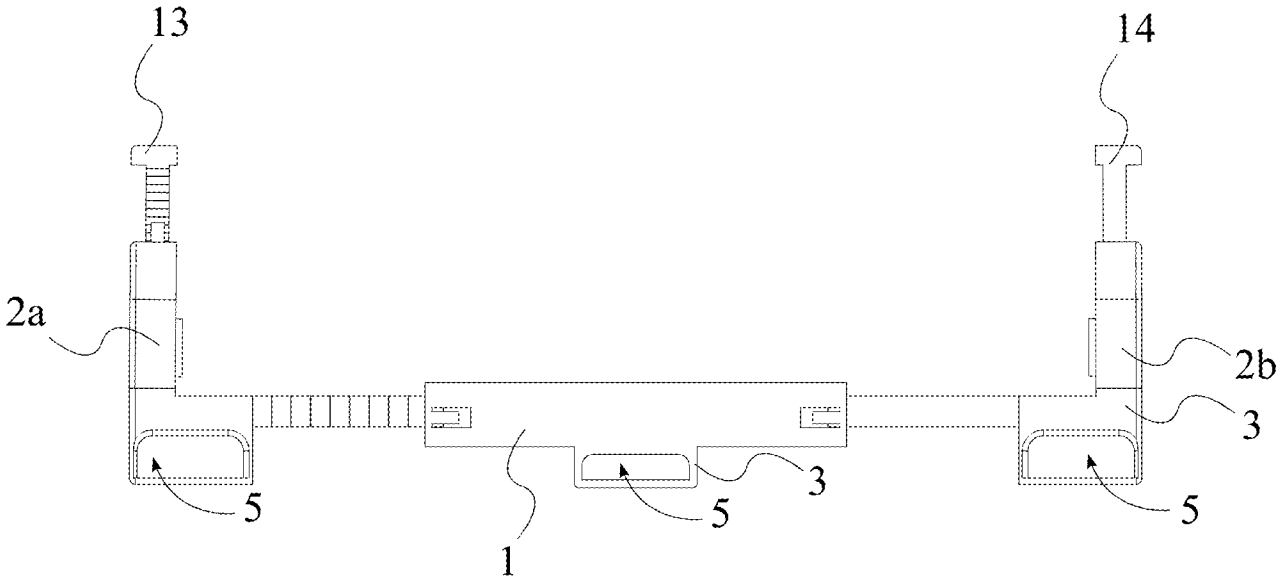
FIG. 8 is a front elevational view of the extendable platform, wherein the sidewalls are placed in an upright position.

As seen in FIG. 6 through FIG. 11, the present invention comprises a first handle 13 and a second handle 14, wherein the first handle 13 is mounted onto the first sidewall 2*a*, and the second handle 14 is mounted onto the second sidewall 2*b*. This is so that the first handle 13 and the second handle 14 enable the user to easily carry the present invention from one location to another with ease. As seen in FIG. 6 through FIG. 8, the firework platform 1 is extendable. Accordingly, the user may extend the platform to hold a plurality of fireworks or a large firework over the firework platform 1, and the user may retract the platform while using a single or smaller sized firework over the firework platform. In the preferred embodiment, the firework platform 1 comprises a center piece with a hollow interior, wherein the extendable side surfaces may be slid inside, into the hollow interior of the center piece when not in use, and may be pulled out when the platform needs to be extended. However, any other technology that is known to one of ordinary skill in the art may be employed for extending and retracting the firework platform.

With reference to FIG. 4, the present invention comprises a griping surface 15. Preferably, the gripping surface 15 is integrated onto the first surface 1*a* of the firework platform 1. This is so that the firework cakes or any other form of firework that is positioned over the firework platform 1 do not slide and slip along the firework platform 1.

It is an aim of the present invention to enable users to operate the fireworks electronically from a distance, such that the user may be at a safe distance from the fireworks during operation. To accomplish this, the present invention comprises an ignition device 16, a microcontroller 17, a power source 18, and a mobile communication device 19. Preferably, the ignition device 16 comprises a plurality of electric wires that are connected to the fuse of the firework cake and can produce a spark to ignite the firework. The microcontroller 17 is a processing device that manages the operation of the electrical components within the present invention. In other words, for achieving the above-mentioned functionality, the ignition device 16 is electronically connected to the microcontroller 17, and the ignition device 16 is connected to a fuse of the at least one firework cake 7. It should be noted that the ignition device 16 and the microcontroller 17 may comprise any brand and technology that is known to one of ordinary skill in the art, as long as the objectives of the present invention are not altered. Further, the microcontroller 17 comprises a wireless communication module 20, wherein the wireless communication module 20 is communicably connected to the microcontroller 17. Preferably, the wireless communication module 20 connects and communicates with external devices via wireless data transmission protocols. In other words, the mobile communication device 19 is operably coupled to the wireless communication module 20, such that operating the mobile communication device 19 enables controlling the ignition device 16 through the microcontroller 17. The mobile communication device 19 may comprise an application in a smart phone or any other smart device. Example standards of what the wireless communication module 20 includes, but are not limited to, Bluetooth, WI-FI, GSM, CDMA, ZigBee, etc. According to the preferred embodiment, the ignition device 16 and the power source 18 may be mounted onto the second surface 1*b* of the firework cake platform 1. However, the ignition device 16 and the power source 18 may be mounted on any other surface, as long as the objectives of the present invention are not altered. Preferably, the power source 18 is a rechargeable battery, that is used to deliver electrical power to the microcontroller 17, and the ignition device 16. Accordingly, the power source 18 is electrically connected to the microcontroller 17.

In an alternate embodiment, the present invention may comprise motion sensors that prevent ignition/bursting of the firework cake, if the motion sensor detects presence of a living thing within a preset radius.

Thus, the present invention is a smart and safe device that maybe used with any fireworks at any locations, making the firework bursting experience tension free and fun for all users.

Although the invention has been explained in relation to its preferred embodiment, it is to be understood that many other possible modifications and variations can be made without departing from the spirit and scope of the invention as hereinafter claimed.

What is claimed is:

1. A support device for fireworks, the device comprising:

a firework platform;

a plurality of sidewalls;

a plurality of weighted legs;

at least one fastener;

a plurality of weight slots;

the firework platform comprising a first surface and a second surface, wherein the second surface being positioned opposite to the first surface across the firework platform;

a first sidewall and a second sidewall being terminally and laterally mounted onto the firework platform, wherein the first sidewall and the second sidewall are from the plurality of sidewalk;

the plurality of weighted legs being mounted onto the second surface;

the at least one fastener being engaged with a corresponding sidewalk, wherein the corresponding sidewall is from the plurality of sidewalls;

each of the plurality of weight slots traversing through a corresponding leg, wherein the corresponding leg is from the plurality of weighted legs;

a support stand;

a support surface;

the support surface being terminally mounted onto the support stand;

the second surface of the firework platform being detachably mounted onto the support surface;

wherein the support stand being a bipedal stand:

the support surface comprising a raised handle;

the raised handle being mounted along a third surface of the support surface;

the raised handle being threaded through a first slot of a first firework platform, wherein the first slot is from the plurality of weight slots; and the first slot being positioned along the center of gravity of the first firework platform.

2. The support device of claim 1, wherein the plurality of sidewalls extending normally from the first surface, opposite to the second surface.

3. The support device of claim 1, comprising:

at least one firework cake;

the at least one firework cake being positioned on the first surface and in between the plurality of sidewalls;

the at least one fastener being operably coupled with the at least one firework cake, such that the at least one fastener securely fastens the at least one firework cake onto the first surface of the firework platform.

4. The support device of claim 1, wherein the plurality of weight slots housing a plurality of detachable weights.

5. The support device of claim 1, wherein the supporting stand being height adjustable.

6. The support device of claim 1, comprising:

wherein the support stand being a tripod stand:

the support surface comprising a plurality of supporting arms; and the plurality of supporting arms being axially mounted onto the support stand.

7. The support device of claim 1, comprising:

a plurality of fastener holes;

each of the plurality of fastener holes laterally traversing a corresponding wall, wherein the corresponding wall is from the plurality of sidewalls;

the at least one fastener being engaged with a corresponding fastener hole, wherein the corresponding fastener hole is from the plurality of fastener holes.

8. The support device of claim 1, comprising:

a first handle and a second handle;

the first handle being mounted onto the first sidewall;

the second handle being mounted onto the second sidewall.

9. The support device of claim 1, wherein the firework platform being extendable.

10. The support device of claim 1, comprising a gripping surface;

the gripping surface being integrated onto the first surface of the firework platform.

11. The support device of claim 1, wherein the plurality of weighted legs and the plurality of weight slots being rectangular.

12. The support device of claim 1, comprising:

an ignition device;

a microcontroller;

a power source;

a mobile communication device;

the microcontroller comprising a wireless communication module;

the ignition device being mounted onto the firework platform;

the ignition device being electronically connected to the microcontroller;

the ignition device being connected to a fuse of at least one firework;

the wireless communication module being communicably connected to the microcontroller;

the power source being electrically connected to the microcontroller;

the mobile communication device being operably coupled to the wireless communication module, such that operating the mobile communication device enables controlling of the ignition device through the microcontroller.

13. A support device for fireworks, the device comprising:

a firework platform;

a plurality of sidewalk;

a plurality of weighted legs;

at least one fastener;

a plurality of weight slots;

at least one firework cake;

the firework platform comprising a first surface and a second surface, wherein the second surface being positioned opposite to the first surface across the firework platform;

a first sidewall and a second sidewall being terminally and laterally mounted onto the firework platform, wherein the first sidewall and the second sidewall are from the plurality of sidewalls;

the plurality of weighted legs being mounted onto the second surface;

the at least one fastener being engaged with a corresponding sidewall, wherein the corresponding sidewall is from the plurality of sidewalls;

each of the plurality of weight slots traversing through a corresponding leg, wherein the corresponding leg is from the plurality of weighted legs;

the at least one firework cake being positioned on the first surface and in between the plurality of sidewalls;

the at least one fastener being operably coupled with the at least one firework cake, such that the at least one fastener securely fastens the at least one firework cake onto the first surface of the firework platform;

a support stand;

a support surface;

the support surface being terminally mounted onto the support stand;

the second surface of the firework platform being detachably mounted onto the support surface;

wherein the support stand being a bipedal stand:

the support surface comprising a raised handle;

the raised handle being mounted along a third surface of the support surface;

the raised handle being threaded through a first slot of a first firework platform, wherein the first slot is from the plurality of weight slots;

the first slot being positioned along the center of gravity of the first firework platform; and wherein the supporting stand being height adjustable and orientation adjustable.

14. The support device of claim 13, comprising:

a plurality of fastener holes;

each of the plurality of fastener holes laterally traversing a corresponding wall, wherein the corresponding wall is from the plurality of sidewalls;

the at least one fastener being engaged with a corresponding fastener hole, wherein the corresponding fastener hole is from the plurality of fastener holes.

* * * * *